United States Patent [19]

Brunt

[11] Patent Number: 4,475,817

[45] Date of Patent: Oct. 9, 1984

[54] MIXER FOR MIXING FIBRES INTO A SLURRY

[75] Inventor: William H. Brunt, Tyldesley, England

[73] Assignee: Pilkington Brothers P.L.C., St. Helens, England

[21] Appl. No.: 541,756

[22] Filed: Oct. 13, 1983

[30] Foreign Application Priority Data

Oct. 21, 1982 [GB] United Kingdom ..... 8230106

[51] Int. Cl.[3] ..... B28C 5/06

[52] U.S. Cl. ..... 366/3; 366/10; 366/34; 366/40; 366/165; 366/177; 366/339

[58] Field of Search ..... 239/405, 406; 366/2, 366/3, 10, 27, 30, 33, 34, 37, 40, 132, 154, 165, 167, 174, 177, 178, 181, 183, 338, 339, 341, 348

[56] References Cited

U.S. PATENT DOCUMENTS

| | | | |
|---|---|---|---|
| 2,884,942 | 5/1959 | Caldwell | 366/165 |
| 4,205,919 | 6/1980 | Attwell | 366/34 |
| 4,367,953 | 1/1983 | Hinz et al. | 366/132 |

*Primary Examiner*—Robert W. Jenkins
*Assistant Examiner*—Arthur D. Dahlberg
*Attorney, Agent, or Firm*—Sughrue, Mion, Zinn, Macpeak and Seas

[57] ABSTRACT

A mixer for mixing glass fibres into a relatively dilute aqueous cement slurry, e.g. for use in forming glass fibre reinforced cement products on an asbestos-cement making machine of the Hatschek or Bell type, comprises an annular chamber with a tangential slurry inlet, a helical rising floor, a coaxial conical outlet disposed to receive slurry flowing over the inner wall, which is lower than the outer wall, and a fibre inlet above the conical outlet so that the fibres are mixed with the slurry as it passes down the wall of the conical outlet in a vortex motion.

4 Claims, 3 Drawing Figures

MIXER FOR MIXING FIBRES INTO A SLURRY

BACKGROUND OF THE INVENTION

1. Field of the Invention

This invention relates to mixers for mixing fibres into a slurry and particularly for mixing glass fibres into a relatively dilute aqueous cement slurry, e.g. for use in forming glass fibre reinforced cement products on an asbestos-cement making machine of the Hatschek or Bell type.

2. Description of the Prior Art

In such machines, a relatively dilute aqueous cement slurry, containing for example from 8 to 30% solids, must be employed. The slurry is deposited on a foraminous surface to form a sheet and, after de-watering, successive sheets are deposited on an accumulator drum to build up a product of the desired thickness. When glass fibres are used instead of asbestos in such machines, difficulty has been experienced in mixing the glass fibres uniformly into the slurry. The glass fibres have a tendency to clump together and to become unevenly distributed in the slurry and hence in the final product, which can thus fail to show the expected strength due to lack of reinforcement in some areas.

SUMMARY OF THE INVENTION

According to the present invention, a mixer for mixing fibres into a slurry, especially for mixing glass fibres into a relatively dilute aqueous cement slurry, comprises an annular chamber with a tangential inlet for the slurry, the top of the inner wall of the annular chamber being substantially lower than its outer wall, a downwardly tapering conical outlet coaxial with the annular chamber and disposed so as to receive slurry flowing over the top of the inner wall, and an inlet for the fibres disposed above the conical outlet so that the fibres fall into the slurry and are mixed with it as the slurry passes down the wall of the conical outlet in a vortex motion.

Introduction of the slurry through the tangential inlet produces rotary motion of the slurry around the annular chamber and when the slurry overflows over the inner wall into the conical outlet this rotary motion is converted into the vortex motion which assists the slurry to absorb the fibres and enables an effective mixing action to take place, resulting in even distribution of the fibres in the slurry.

Preferably the annular chamber has a floor which is inclined to form a rising helix extending from the bottom of the tangential inlet to a position overlying the top of the inlet.

In a preferred construction, the conical outlet is attached to the inner wall of the annular chamber near the top of said inner wall.

Preferably the inlet for the fibres is a tube whose diameter is less than that of the inner wall of the annular chamber and which terminates within the chamber above the top of the inner wall.

The invention also resides in the method of mixing glass fibres into a relatively dilute aqueous cement slurry, wherein the slurry is introduced into an annular chamber, whose inner wall is lower than its outer wall, through a tangential inlet so as to cause the slurry to move around the chamber in a rotary motion, the slurry is caused to overflow the inner wall on to a conical downwardly tapering outlet where it acquires a vortex motion, and the glass fibres are caused to fall on to the slurry in the conical outlet and thereby to be mixed into the slurry by means of the vortex motion.

DETAILED DESCRIPTION OF THE INVENTION

Figure 1:
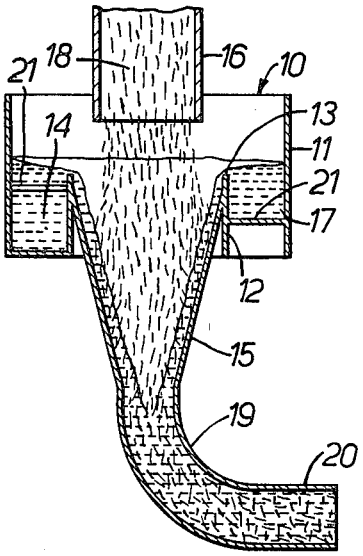
FIG. 1 is a vertical sectional view through a mixer for mixing glass fibres into a relatively dilute aqueous cement slurry.
Figure 2:
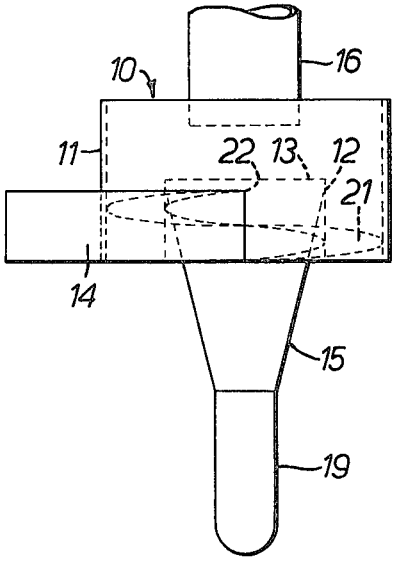
FIG. 2 is an elevation of the mixer, seen from the left-hand side of FIG. 1.
Figure 3:
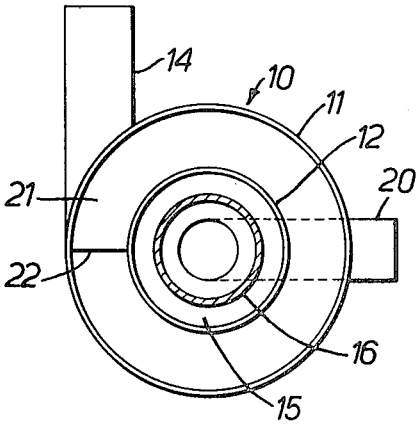
FIG. 3 is a plan view of the mixer.

The mixer shown in the drawings is intended for mixing glass fibres into a relatively dilute aqueous cement slurry having a solids content of from 8 to 30%, e.g. for making glass fibre reinforced cement products on an asbestos cement machine of the Hatschek or Bell type, as referred to above.

The mixer comprises an annular chamber 10 having an outer wall 11 and an inner wall 12, the top 13 of the inner wall being substantially lower than that of the outer wall 11. A tangential inlet 14 of square section is provided for introducing the slurry. The height of the square section inlet 14 is less than the height of the inner wall 12. The floor 21 of the annular chamber 10 is inclined to form one complete turn of a rising helix extending from the bottom of the inlet 14 to a position 22 overlying the top of the inlet.

The outlet from the mixer is constituted by a downwardly tapering conical passage 15 coaxial with the annular chamber 10 and attached to the inner wall 12 so as to receive slurry flowing over the top 13 of the inner wall 12. A tubular inlet 16 for the glass fibres, which are preferably in the form of chopped strands, is disposed coaxially above the conical outlet passage 15. The diameter of the fibre inlet 16 is less than that of the inner wall 12 and it terminates within the chamber 10 above the top 13 of the inner wall 12, so that glass fibres falling from the inlet 16 fall into the conical outlet passage 15.

The conical outlet passage 15 leads through a curved tubular section 19 to a final horizontal outlet 20.

In use, slurry is fed to the inlet 14 from a constant head device so as to ensure a steady flow without surging. When the slurry 17 is thus introduced through inlet 14 into the annular chamber 10, it moves around the chamber 10 in a rotary motion until it overflows over the top 13 of the inner wall 12. The helical floor 21 ensures that, as the slurry completes a revolution around the annular chamber 10, it is raised above the level of the fresh incoming slurry. Any clinker (which is associated with some cements) is thus raised above the incoming slurry and is assisted to flow over the top of the inner wall 12 with the rest of the slurry. On the other hand, any heavy solid particles and/or objects which might cause damage to the processing equipment downstream of the mixer fall back from the end 22 of the helical floor 21 into the bottom of the chamber 10 and are thus retained in the mixer, from which they can be removed from time to time.

After flowing over the top of the inner wall 12, the slurry executes a vortex motion down the wall of the conical outlet 15. This vortex motion helps the slurry to absorb the glass fibres 18 falling from the fibre inlet 16 and enables an effective mixing action to take place, so that the glass fibres are evenly distributed throughout the slurry which is removed through the final outlet 20.

I claim:

1. A mixer for mixing fibres into a slurry, comprising an annular chamber with a tangential inlet for the slurry, the top of the inner wall of the annular chamber being substantially lower than its outer wall, a floor in the annular chamber which is inclined to form a rising helix extending from the bottom of the tangential inlet to a position overlying the top of the inlet, a downwardly tapering conical outlet coaxial with the annular chamber and disposed so as to receive slurry flowing over the top of the inner wall, and an inlet for the fibres disposed above the conical outlet so that the fibres fall into the slurry and are mixed with it as the slurry passes down the wall of the conical outlet in a vortex motion.

2. A mixer according to claim 1 wherein the conical outlet is attached to the inner wall of the annular chamber near the top of said inner wall.

3. A mixer according to claim 1 wherein the inlet for the fibres is a tube whose diameter is less than that of the inner wall of the annular chamber and which terminates within the chamber above the top of the inner wall.

4. A method of mixing glass fibres into a relatively dilute aqueous cement slurry, wherein the slurry is introduced through a tangential inlet into an annular chamber, whose inner wall is lower than its outer wall and which has a rising helical floor, so as to cause the slurry to move around the chamber in a rotary motion incorporating an upward component, the slurry is caused to overflow the inner wall on to a conical downwardly tapering outlet where it acquires a vortex motion, and the glass fibres are caused to fall on to the slurry in the conical outlet and thereby to be mixed into the slurry by means of the vortex motion.

* * * * *